US006647565B2

(12) United States Patent
Smale

(10) Patent No.: US 6,647,565 B2
(45) Date of Patent: Nov. 18, 2003

(54) DRAINAGE SURFACE CONSTRUCTION

(76) Inventor: Gregory John Smale, 90 Shakespeare Rd., Milford, Auckland (NZ)

( * ) Notice: Subject to any disclaimer, the term of this patent is extended or adjusted under 35 U.S.C. 154(b) by 0 days.

(21) Appl. No.: 10/094,468

(22) Filed: Mar. 8, 2002

(65) Prior Publication Data

US 2002/0124306 A1 Sep. 12, 2002

(30) Foreign Application Priority Data

Mar. 9, 2001 (NZ) ..... 510443

(51) Int. Cl.[7] ..... A47K 3/22
(52) U.S. Cl. ..... 4/613; 4/592; 4/584
(58) Field of Search ..... 4/592, 584, 548, 4/613; 52/302.1, 302.4

(56) References Cited

U.S. PATENT DOCUMENTS

| | | | | | |
|---|---|---|---|---|---|
| 4,938,825 | A | * | 7/1990 | Macdonald | 156/245 |
| 5,140,789 | A | * | 8/1992 | De Gooyer | 52/71 |
| 5,778,464 | A | * | 7/1998 | Chapple et al. | 4/596 |
| 6,058,659 | A | * | 5/2000 | Astrom | 52/34 |
| 6,155,015 | A | * | 12/2000 | Kirby | 52/302.1 |
| 6,161,353 | A | * | 12/2000 | Negola et al. | 52/453 |

* cited by examiner

*Primary Examiner*—Gene Mancene
*Assistant Examiner*—Azy Kokabi
(74) *Attorney, Agent, or Firm*—Wendy M. Lee

(57) ABSTRACT

This application describes a method of constructing a surface for drainage, and a kit of parts forming components required to produce such a drainage surface.

17 Claims, 5 Drawing Sheets

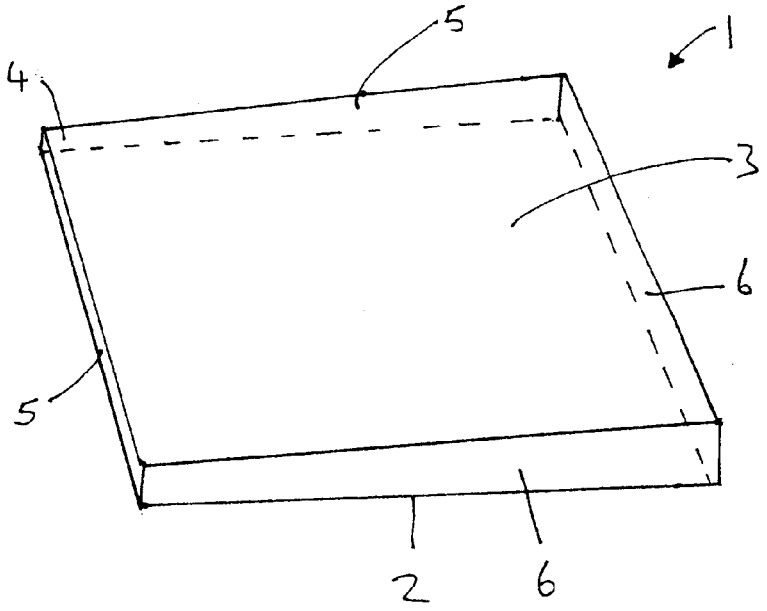
FIGURE 1
FIGURE 2A
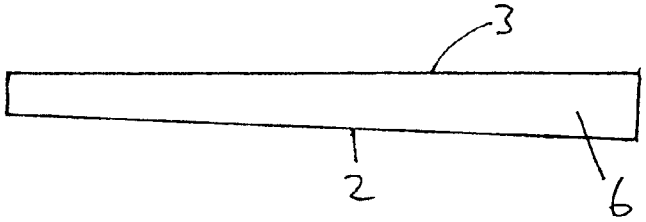
FIGURE 2B
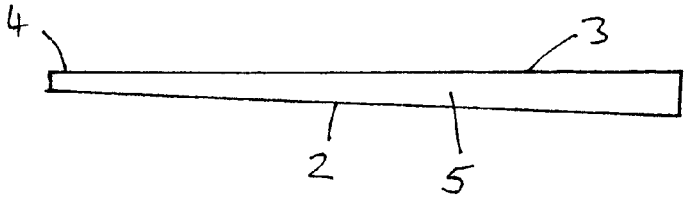

DRAINAGE SURFACE CONSTRUCTION

This is a non-provisional application claiming priority under 35 USC Section 119 (a)–(d) to New Zealand patent application 510,443 filed Mar. 9, 2001, the contents of which are incorporated herein by reference.

BACKGROUND OF THE INVENTION

1. Field of the Invention

This invention relates to a method of constructing a surface for drainage, and a kit of parts forming components required to produce such a drainage surface.

2. State of the Art

The conventional method of producing a drainage surface which slopes from several or all sides to a common drainage point is to first form a solid base with the required slope or slopes, for example using plaster or cement, and then to apply some form of sealant and/or surface coating to that surface. For example, in the construction of a tiled shower base, the conventional approach is to decide where the drainage point is to be; then to create drainage surfaces, with plaster or cement, extending from that drainage point to the intended perimeter of the shower; allowing the cement to dry (which may take several days); sealing the dry surface (for example with a fibreglass sheet); and then tiling the sealed surface. This is a time consuming process requiring the skills of several different trades.

The alternative means of producing a shower base is to use a prefabricated base. However, pre-fabricated bases do not result in a product with the same aesthetic qualities. Furthermore, the positioning of the drainage point is essentially fixed with a pre-fabricated base.

U.S. Pat. No. 5,140,789 (De Gooyer) describes a segmented underlay for use in installing a tile floor of a shower. In use, the members of the underlay are placed in the desired position on the subfloor, the shower pan is then laid on the underlay, and tiles are adhered to the pan. The product in U.S. Pat. No. 5,140,789, advertised under the tradename PRO-SLOPE™ by The Noble Company (www.noblecompany.com), is formed from expanded polystyrene. The instructions for installing the product require that a mortar bed be laid on the PRO-SLOPE™ product and tiles are adhered to the mortar bed. The PRO-SLOPE™ product comes with "extensions" which are used where the wall is more than 20" from the center of the drain. The extensions are not pre-sloped, so, if a slope is desired, it must be created under the extension. For more information, see wwww.noblecompany.com/pdf/proinstall.pdf.

3. Objectives

It is an object of the present invention to provide a method of constructing a drainage surface, a panel for such a construction, and/or a kit of parts to produce such a surface, which reduces or overcomes at least one of the above-mentioned problems, or which at least provides the public with a useful alternative.

Other objects of the invention may become apparent from the following description which is given by way of example only.

BRIEF DESCRIPTION OF THE INVENTION

According to one aspect of the present invention there is provided a method of constructing a drainage surface for a drainage area having a defined drainage point, the method including:

(a) defining the drainage area, (b) defining the drainage point within the drainage area, (c) taking a plurality of uniform support members, each support member comprising a planar unit and including one substantially flat surface and an opposite drainage surface forming a slope from an outer region at which the unit is thicker to an inner corner at which the unit is thinner, the plurality of support members capable of forming a substantially continuous drainage surface when the inner corners adjoin the drainage point;

(e) if required, cutting or shaping outer regions of the support members to fit the defined drainage area;

(f) positioning the support members in the defined drainage area to form a substantially continuous drainage surface;

(g) forming a seal over the support members.

In one preferred form, each uniform support member may be in the form of a substantially square panel or a substantially right-angle triangular panel.

Preferably, the support members, or at least the outer regions thereof, are formed from a rigid foam material with a density from about 80 to about 200 kilograms of chemical per cubic meter of final product, and most preferably about 100 kilograms of chemical per cubic meter of final product. For instance, the support members may be formed from rigid polyurethane foam (generally comprising a mixture of polyol/isocyanate). Such polyurethane foam may be purchased commercially from Bayer.

Various advantages are thought to be associated with the material used to make the support members herein, especially compared to the polystyrene foam material of the PRO-SLOPE™ device. In particular, the support members are formed from material that is denser and more rigid than the PRO-SLOPE™ material, but, nonetheless, is readily cut, snapped or shaped, e.g. using a knife or other tool. Also, the support members are formed from a material to which a waterproof membrane can readily adhere, without pretreatment. Moreover, due to the characteristics of the support members herein, a shower pan or mortar base between the support members and the tiles is no longer required. Hence, the thickness of the base at the waste position is reduced to a much lower profile than the outside edge of the drainage surface, compared to a drainage surface which includes a mortar bed between the tiles and a support member.

Preferably, the slope on the drainage surface of each support member may have an angle in the range 1.5–3°; more preferably an angle of about 2°.

In an alternative form, the method may further include the use of supplementary support members to complete the drainage surface, each said supplementary support member having one flat surface and an opposing surface sloping at substantially the same angle as the main support members, said supplementary support members adapted to abut or engage with an outer edge of a main support member and continue the slope of the drainage surface.

In one preferred form the drainage surface may be a shower base.

According to a further aspect of the present invention there is provided a drainage surface formed by a method as herein described.

According to a further aspect of the present invention there is provided a kit of parts for constructing a drainage surface for a drainage area having a defined drainage point, said kit of parts including a plurality of uniform support members each support member comprising a planar unit and including one substantially flat surface and an opposite drainage surface forming a slope from an outer region at which the unit is thicker to an inner corner at which the unit is thinner, the plurality of support members capable of forming a substantially continuous drainage surface when the inner corners adjoin the drainage point.

Preferably each uniform support member may be in the form of a substantially square panel or a substantially right-angle triangular panel.

Preferably, the kit of parts may include four uniform support members.

In a further preferred form the kit of parts may further include a plurality of supplementary support members, each supplementary support member having one flat surface and an opposing surface sloping at substantially the same angle as the main support members, said supplementary support members adapted to abut or engage with an outer edge of a main support member and continue the slope of the drainage surface.

Preferably the kit of parts may include at least four supplementary support members.

Preferably the kit of parts may further include at least one sill section, the or each sill adapted to define a limit to the drainage area. Preferably, the sill has a sloped surface and optionally has a greater slope than the support members and/or supplementary support members (for instance, about 2–4° C., more preferably about 3° C.).

According to a further aspect of the invention there is provided a support member for supporting a drainage surface in a drainage area having a defined drainage point, said support member comprising a planar unit and including one substantially flat surface, an opposite drainage surface forming a slope from an outer region at which the unit is thicker to an inner corner at which the unit is thinner, and edges extending from the inner corner to the outer region, each edge adapted to abut or interengage with a corresponding edge of an adjacent support member to extend the drainage surface in a substantially continuous manner, and, said inner corner having an angle divisible into 360°.

Preferably the drainage surface may slope at an angle in the range 1.5–3°; more preferably about 2°.

In one preferred form the support member may be in the form of a substantially square panel or a substantially right angle triangular panel.

Preferably, the support member, or at least the outer regions thereof, is made from a rigid foam material with a density from about 80 to about 200 kilograms of chemical per cubic meter of final product.

Other aspects of the present invention may become apparent from the following description which is given by way of example only.

BRIEF DESCRIPTION OF THE DRAWINGS

FIG. 1: shows a perspective view of a support member of the invention, in one preferred form;

FIGS. 2A–B: show an end view of outer sides A of the support member of FIG. 1 and an end view of inner sides B of the support member of FIG. 1;

DETAILED DESCRIPTION OF THE INVENTION

Figure 3:
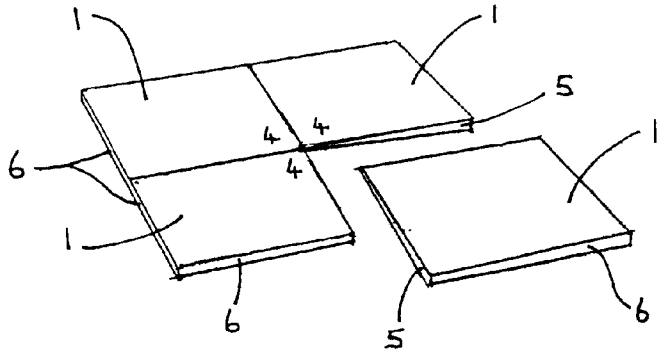
FIG. 3: shows the combination of four support members of FIG. 1 to form a support for a drainage surface.

The drawings and the following description make specific reference to a method of construction of a drainage surface for a shower, and to components used in that method of construction. However, it will be appreciated that the same principles can be applied to any drainage surface having a defined area, and requiring a drainage point within that area.

The method involves the use of a plurality of support members of common dimensions, and optionally supplementary support members, depending on the dimensions of the drainage area, to form an upper surface which creates a substantially continuous surface sloping from outer edges of the drainage area to a drainage point. The support members (and supplementary support members) are formed of a material which is light, easy to handle and readily cut, snapped or shaped, as required. Polyurethane rigid foam may be a preferred choice of material.

With reference to FIG. 1, a main support member 1 may comprise a square panel having a flat base 2 and an upper surface 3 which slopes towards a central corner 4. The support member 1, therefore, has common internal edges 5 (as shown in FIG. 2*b*) and common external edges 6 (as shown in FIG. 2*a*).

To form a drainage surface four support members 1 are put together, as shown in FIG. 3, with their central corners 4 adjacent one another, and with internal edges 5 abutting one another. It will be appreciated that in the simplest form the internal edges 5 may simply abut one another, whilst in more complex forms an interlocking arrangement could be used. In the completed support for a drainage surface of FIG. 3 there is a slope from all external edges 6 of the drainage area towards the central point.

Figure 5A:
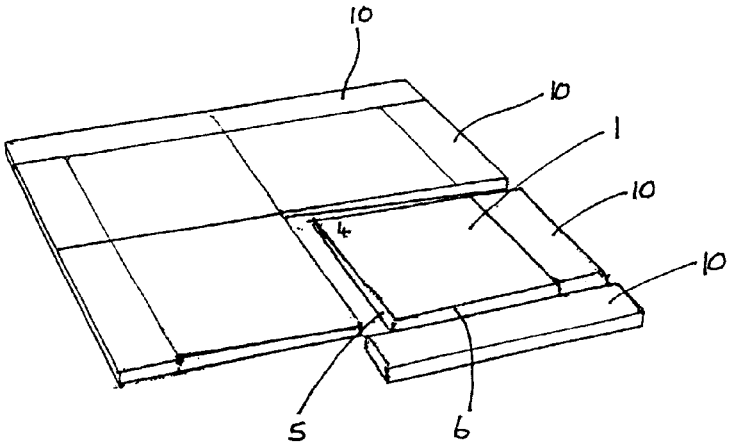
FIGS. 5A & B: show perspective views of the use of support members and supplementary support members in the configuration of supports for drainage surfaces of different dimensions.
Figure 5B:
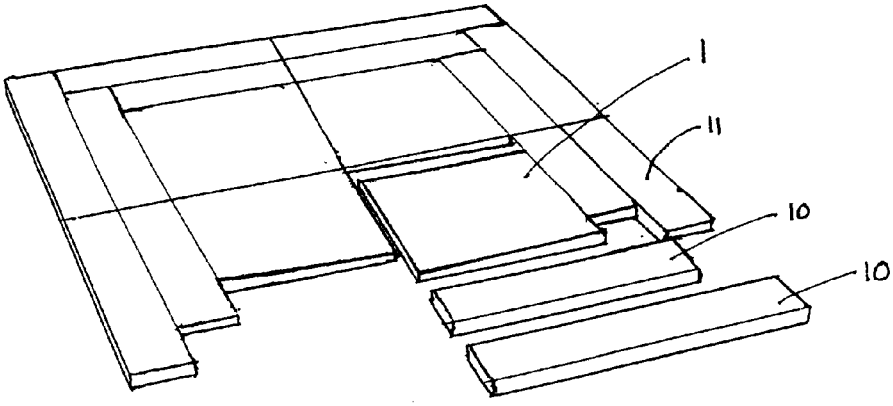
Figure 4A:
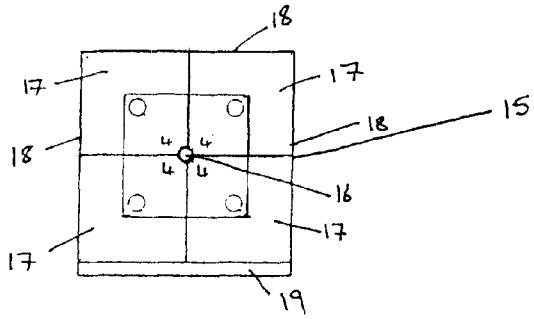
FIGS. 4 A–D: shows application of a combination of support members of FIG. 1 in the construction of drainage surfaces having drainage points in different positions and/or for different shaped drainage surfaces.
Figure 4B:
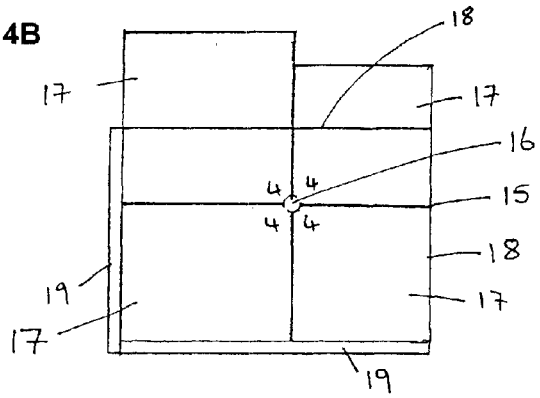
Figure 4C:
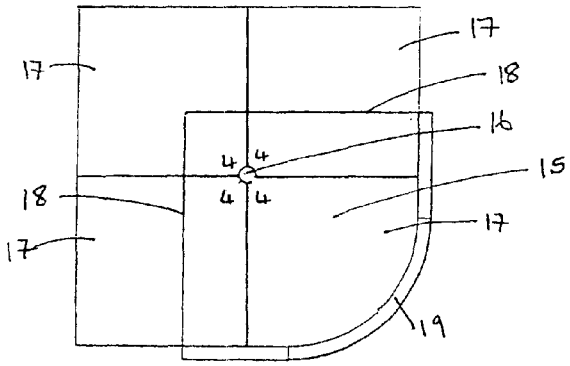
Figure 4D:
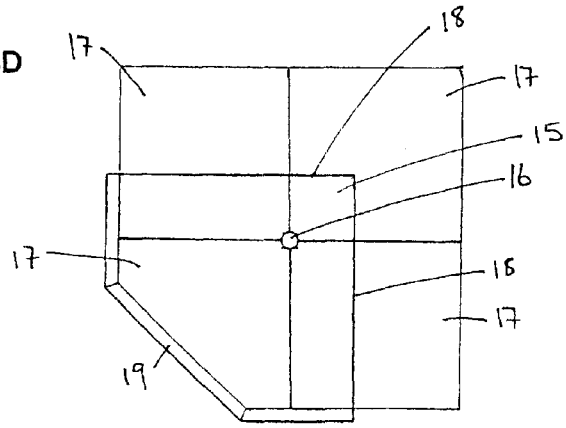

With reference to FIG. 5, for larger drainage areas supplementary support members 10 may be used. These supplementary support members 10, in this embodiment, are rectangular panels formed of the same materials as the main support members 1, and including an upper surface having the same slope or slopes as that of the main support members 1. Thus, the upper slopes 11 of the supplementary support members 10 are designed to extend the slope of the drainage surface from outer edges 6 of the main support members 1.

With reference to FIG. 4, drainage areas 15 requiring a supporting structure may be of different shapes (as represented in FIGS. 4A–D). In addition, the drainage point 16 may not be central. For example, with shower construction there may be joists or other structural obstacles which determine where the drainage point can be. Once the drainage point 16 has been defined, then that point forms the center of the support configuration formed by a set of support members 17, ie, where the central corners 4 meet. Each main support member 17 of the set is then cut, snapped or shaped (if necessary) according to the required drainage area. Supplementary support members 10 may be included where necessary to extend the outer edges of the support surface.

It will be appreciated that the drainage point may be positioned at any location within the drainage area; the design of the support members, provided as a plurality of uniform members, enabling the creation of a substantially continuous drainage surface to the selected drainage point.

For the construction of a drainage surface, and particularly a shower base 15, there is a need to define at least some edges of the drainage area. For example, a shower base may be in an area defined by three walls 18 (as in FIG. 4A), or only defined by two walls 18 (as in FIGS. 4B, C and D), in which case sills 19 are required to complete the definition of the drainage area 15.

Once the drainage area has been defined by positioning and securing the sills 19, the drainage point 16 is then identified and, optionally, the drain positioned. The required dimensions of each support member 17 can then be calculated, and the exterior edges cut, snapped or shaped to the required dimensions before those support members 17 are located in their positions in the drainage area 15, with their central corners 4 adjacent the drainage point 16. The drainage surface can then be sealed, for example by the application of a fibreglass layer over the support members. In the case of a shower, this fibreglass may extend up the walls 18 and over the sill 19.

The sealed drainage surface is then ready for covering with the required finishing surface, for example tiling. The invention herein obviates the need for a mortar bed or shower pan to be laid prior to tiling.

Figure 7A:
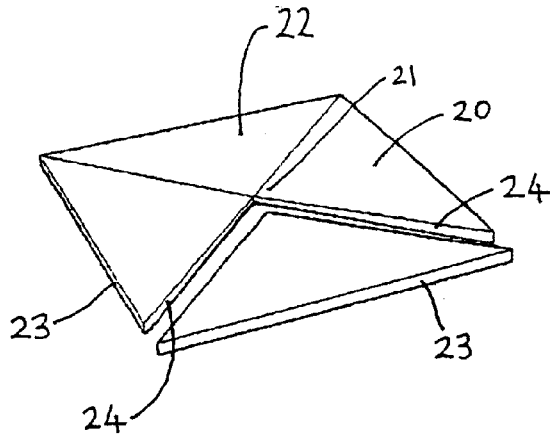
FIGS. 7A–C: shows perspective views of combinations of support members, in an alternative embodiment of the invention, in various combinations to form the support for a drainage surface.
Figure 7B:
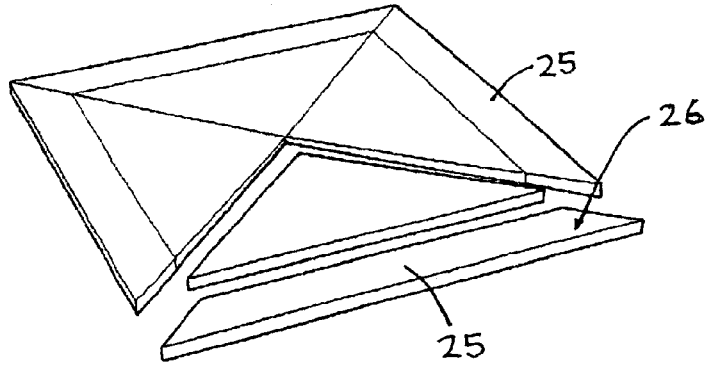
Figure 7C:
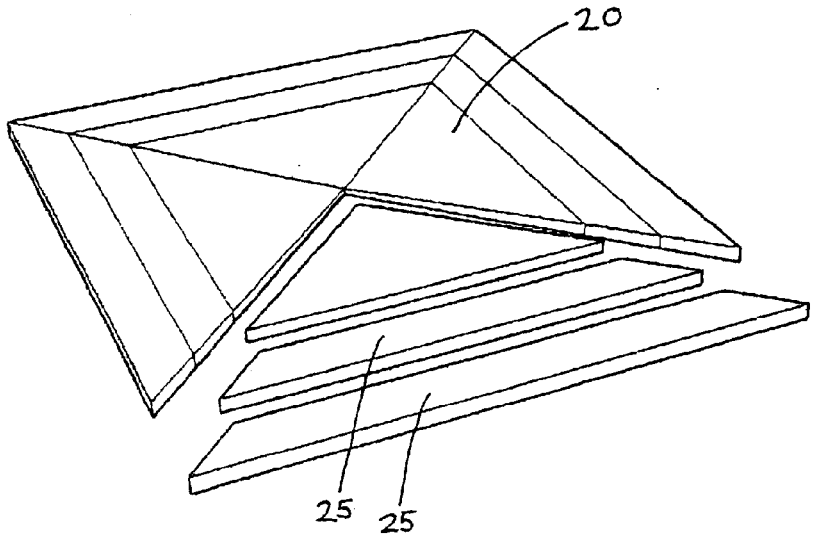

FIG. 7 shows the use of support members which are triangular rather than square. Each support member 20 has a central corner 21, from which the upper surface 22 slopes upwards towards the exterior edge 23. The interior edges 24 abut or interengage in the formed support for the drainage surface. Supplementary support members 25 have a trapezoidal shape and an upper surface 26 having a slope common to the slope of the main support members 20.

The angle of the slope on the upper surface of the support members and supplementary support members must be sufficient to enable drainage to the drainage point, but generally not so steep as to make standing on the surface difficult or uncomfortable. The slope is preferably in the range 1½–3°, and most preferably about 2°.

It will be appreciated that whilst the invention is described with specific reference to the support members being either square or right angle triangles, the invention is not limited to such configurations. For example, the support members could be rectangular, or any other shape providing that the central corners of a plurality of the support members are divisible into 360° and the internal edges can abut or interengage to form a substantially complete drainage surface.

To enable quick and simple production of a required drainage surface, it is envisaged that the support members of the invention will be supplied in kits. Those kits will include sufficient common support members to complete support for a drainage surface ie, where the support members are square there will be four, where the support members are right angle triangles there will also be four, but where the central corner of the common support member is other than 90° there may be more or less common support members. Optionally the kit may also include a plurality of supplementary support members and/or one or more sections of sill.

Figure 6:
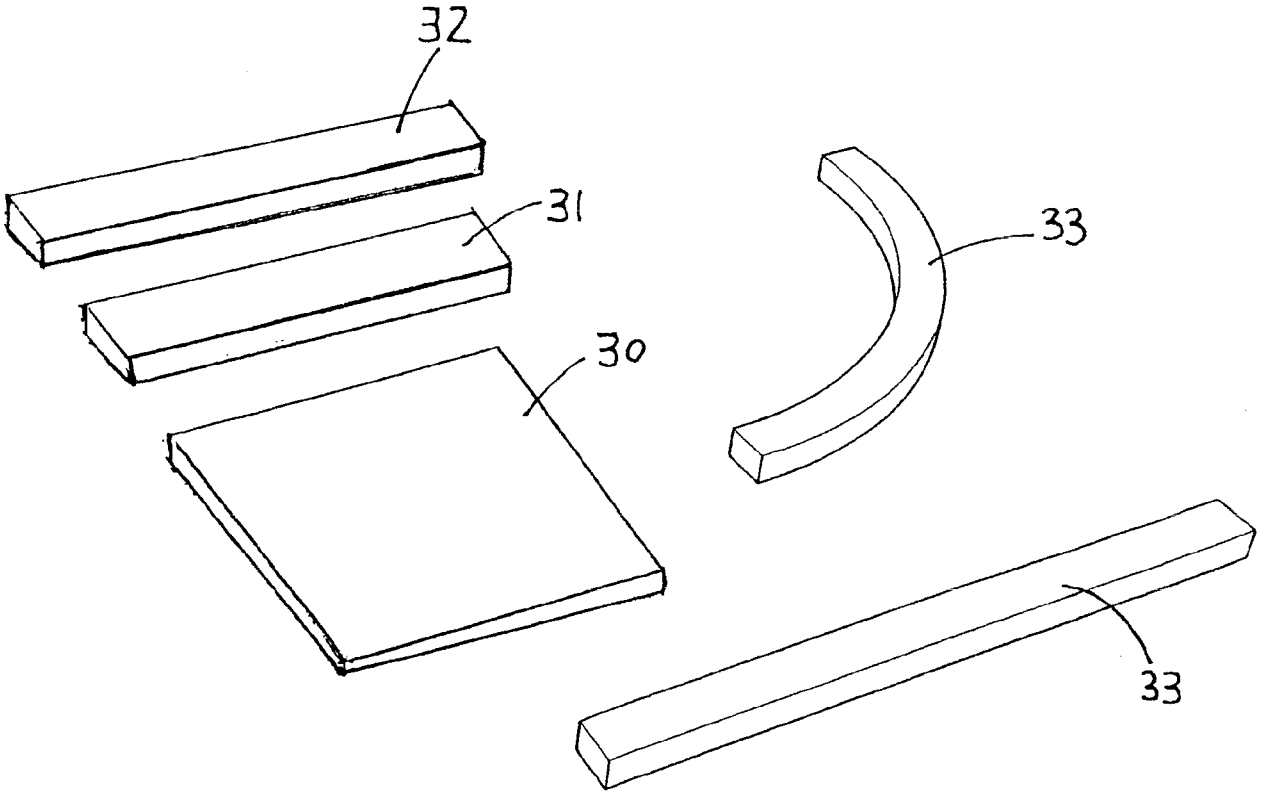
FIG. 6: shows perspective views of components, pluralities of which may be included in a kit set of the present invention for forming a support for a drainage surface.

FIG. 6 represents a selection of support members 30, 31, 32 and sills 33 which may be included in a kit, although it will be appreciated that a kit with such components would include at least four main support members 30, and even numbers of supplementary support members 31 (and/or) 32; preferably eight pieces each of the supplementary support members 31, 32.

Thus, the method of the invention, and the kit of parts, enable the production of a drainage surface in a defined drainage area without the need for first forming a support surface from plaster or concrete. A shower base, for example, could be quickly and efficiently installed by the shower installer without the services of a plasterer or the delay associated with drying of plaster or concrete. Furthermore, the invention enables the production of a drainage surface with a drainage point located at any selected site in the drainage area. This provides a substantial advantage over pre-fabricated shower bases which have a fixed drainage point or must be custom made.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope or spirit of the invention.

What is claimed is:

1. A method of constructing a drainage surface for a drainage area having a defined drainage point, the method including:

(a) defining the drainage area;

(b) defining the drainage point within the drainage area;

(c) taking a plurality of uniform support members, each support member comprising a planar unit and including one substantially flat surface and an opposite drainage surface forming a slope from an outer region at which the unit is thicker to an inner corner at which the unit is thinner, the plurality of support members capable of forming a substantially continuous drainage surface when the inner corners adjoin the drainage point, and wherein the support members are formed from rigid polyurethane foam;

(d) if required, cutting or shaping outer regions of the support members to fit the defined drainage area;

(e) positioning the support members in the defined drainage area to form a substantially continuous drainage surface; and (f) forming a seal over the support members.

2. The method of claim 1 wherein tiles are attached to the support members, without a mortar bed or shower pan therebetween.

3. The method of claim 1 wherein each uniform support member is in the form of a substantially square panel or of a substantially right-angle triangular panel.

4. The method of claim 1 wherein the rigid polyurethane foam has a density from about 80 to about 200 kilograms of chemical per cubic meter of final product.

5. The method of claim 1 wherein the slope on the drainage surface of each support member has an angle in the range 1.5–3°.

6. The method of claim 1 which further includes the use of supplementary support members to complete the drainage surface, each said supplementary support member having one flat surface and an opposing surface sloping at substantially the same angle as the main support members, said supplementary support members adapted to abut or engage with an outer edge of a main support member and continue the slope of the drainage surface.

7. The method of claim 1 wherein the drainage surface is a shower base.

8. A drainage surface formed by a method of claim 1.

9. A kit of parts for constructing a drainage surface for a drainage area having a defined drainage point, said kit of parts including a plurality of uniform support members each support member comprising a planar unit and including one substantially flat surface and an opposite drainage surface forming a slope from an outer region at which the unit is thicker to an inner corner at which the unit is thinner, the plurality of support members capable of forming a substantially continuous drainage surface when the inner corners adjoin the drainage point, and wherein the support members are formed from a rigid foam material with a density from about 80 to about 200 kilograms of chemical per cubic meter of final product.

10. The kit of claim 9 wherein each uniform support member is in the form of a substantially square panel or a substantially right-angle triangular panel.

11. The kit of claim 9 which includes four uniform support members.

12. The kit of claim 9 which includes a plurality of supplementary support members, each supplementary support member having one flat surface and an opposing surface sloping at substantially the same angle as the main support members, said supplementary support members adapted to abut or engage with an outer edge of a main support member and continue the slope of the drainage surface.

13. The kit of claim 12 which includes at least four supplementary support members.

14. The kit of claim 12 which further includes at least one sill section, the or each sill adapted to define a limit to the drainage area.

15. A support member for supporting a drainage surface drainage area having a defined drainage point, said support member comprising a planar unit and including one substantially flat surface, an opposite drainage surface forming a slope from an outer region at which the unit is thicker to an inner corner at which the unit is thinner, and edges extending from the inner corner to the outer region, each edge adapted to abut or interengage with a corresponding edge of an adjacent support member to extend the drainage surface in a substantially continuous manner, and, said inner corner having an angle divisible into 360°, and wherein the support member is formed from a rigid foam material with a density from about 80 to about 200 kilograms of chemical per cubic meter of final product.

16. The support member of claim 15 wherein the drainage surface slopes at an angle in the range 1.5–3°.

17. The support member of claim 15 which is in the form of a substantially square panel or a substantially right-angle trianglar panel.

* * * * *